United States Patent [19]

Salyer

[11] Patent Number: 4,858,972

[45] Date of Patent: Aug. 22, 1989

[54] DOOR OPENING LIMITING BAR

[76] Inventor: Sidney C. Salyer, 1826 Dixon La., Concord, Calif. 94521

[21] Appl. No.: 233,894

[22] Filed: Aug. 15, 1988

Related U.S. Application Data

[63] Continuation of Ser. No. 98,936, Sep. 21, 1987, abandoned.

[51] Int. Cl.[4] ..... E05C 17/30

[52] U.S. Cl. ..... 292/338; 292/DIG. 60

[58] Field of Search ..... 292/338, 339, 262, 259, 292/DIG. 60

[56] References Cited

U.S. PATENT DOCUMENTS

| | | | |
|---|---|---|---|
| 2,421,275 | 5/1947 | Lopez | 292/259 |
| 2,760,806 | 8/1956 | Woodard et al. | 292/338 |
| 2,768,850 | 10/1956 | Minnis, Jr. | 292/338 X |
| 3,955,841 | 5/1976 | Walker | 292/262 X |
| 4,015,867 | 4/1977 | Siden | 292/262 |
| 4,070,049 | 1/1978 | Brewer | 292/338 X |
| 4,231,599 | 11/1980 | Gayman | 292/339 |
| 4,290,636 | 9/1981 | Steele | 292/338 |
| 4,330,147 | 5/1982 | Nolen | 292/259 R |
| 4,346,926 | 8/1982 | Lucas | 292/338 |
| 4,348,879 | 9/1982 | Knierim | 70/93 |
| 4,676,536 | 6/1987 | Arbic et al. | 292/339 |

*Primary Examiner*—Richard E. Moore

*Attorney, Agent, or Firm*—Schapp and Hatch

[57] ABSTRACT

A door opening limiting bar having an elongated rigid member mountable between a first bracket attached to the inner face of a hinged door and a second bracket attached to a wall confronting the inner face of the door at approximately the same height as the first bracket and with the bar extending diagonally between the brackets. The bar is axially expandable and contractable for adjusting the position of the door relative to its frame.

13 Claims, 1 Drawing Sheet

DOOR OPENING LIMITING BAR

This is a continuation of co-pending application Ser. No. 07/098,936 filed on Sept. 21, 1987, and now abandoned.

BACKGROUND OF THE INVENTION

1. Field of the Invention

This invention relates to apparatus for limiting the distance a door can be opened farther from a completely shut position or a partly opened position.

2. Description of the Prior Art

Many devices have been proposed for keeping doors closed against unwanted intrusion. Perhaps the earliest of these devices is a simple bar which drops into upwardly opening brackets secured to the door frame on opposite sides of the door. While the bar is quite effective in keeping the door shut, it must be lifted from its supporting brackets in order to open the door at all, even an inch or two. This makes it difficult for the person inside the room to ascertain who, if anyone, is on the other side of the door before removing the bar. Fish eye lenses are only partially successful, and do not permit the door to be opened only an inch or two for speaking through the door or for passing papers and the like from the outside to the inside or vice versa. Moreover, most door frames are relatively flimsy and even a barred door can often be forced open by a sharp kick or slamming a person's body against the door.

The conventional barred door requires that large and often unsightly brackets be mounted on the door frames. Attempts to eliminate this problem have resulted in elongated rods which are wedged between the doorknob and the floor a foot or two away from the door. While these devices are quite strong in resisting door opening from a closed position, they often display a unfortunate tendency to slip on the floor, and the conventional doorknob structure is quite weak and often will not hold together under repeated blows upon the door from the outside.

Other devices have been proposed which wedge a tube or bar diagonally between the inner side of the door and the wall which the inner side of the door confronts when the door is in open position. Often, such device is pivotally fastened to the inner face of the door and is held from slipping on the wall by braces. These devices have the advantage that when not in use they can be rotated to lie flat against the door and not impede its normal use. Typical of the bars wedged between the doorknob and the floor are those disclosed in the following U.S. Pat. Nos.:

| U.S Pat. No. | Inventor |
|---|---|
| 4,231,599 | Charles Gayman |
| 4,290,636 | Richard J. Steele |
| 4,676,536 | Harold J. Arbic et al. |

Typical of bars wedged between the door and a confronting wall are the disclosures found in the following U.S. Pat. Nos.:

| U.S. Pat. No. | Inventor |
|---|---|
| 2,760,806 | Burnice Woodard et al. |
| 4,346,926 | Frank E. Lucas |

Other patents which may be deemed to be of interest in connection with the present application are 4,015,867 to Lars Siden and 4,348,879 to Donald V. Knierim.

Attempts have been made in connection with the devices described above to permit opening of the door by a few inches. For example, U.S. Pat. No. 4,346,926 to Frank E. Lucas provides a stop rod which is too short to engage the wall until the door has been placed slightly ajar. In this embodiment, the door cannot be prevented from opening from its entirely closed position.

With all of the prior art devices, the door cannot be selectively blocked in closed position, then partially opened an inch or two, then moved back to closed position even with an attempted intruder pushing against the door. Conventionally, doors utilizing bars, wedge bars, and the like are provided with a separate device for restricting opening of the door once the restraining device is disengaged. These door opening restricting devices are usually chains of limited length engaged between brackets on the door and on the door frame. Such devices are flimsy, and chain-restricted doors can normally be kicked open with comparative ease.

The above-listed patents are believed to be relevant to the present invention because they were adduced by a prior art search made by an independent searcher, and a copy of each of the above-listed patents is supplied to the Patent and Trademark Office herewith.

The term "prior art" as used herein or in any statement made by or on behalf of applicant means only that any document or thing referred to as prior art bears, directly or inferentially, a date which is earlier than the effective date of this application.

No representation nor admission is made that any of the above-listed documents is part of the prior art in any acceptation of that term, or that no more pertinent information exists.

SUMMARY OF THE INVENTION

The present invention provides a door opening limiting bar detachably mountable on bracket members attached to the inner face of a door and to a confronting wall at approximately the same height from the floor. In this position, attempts to force the door open impose axially compressive loads on the bar, which it is easily able to resist. The door can thus be held against forced opening in completely closed position, or held against being shoved farther open from in a position wherein the door is open a short distance, say one to two inches.

The door opening limiting bar of the present invention is formed for ready disengagement by simply lifting one end of the bar out of one of the brackets. When this is done, the bar can be swung diagonally flat against the wall, still secured to the wall bracket, or may be swung diagonally flat against the door, with the door opening limiting bar remaining secured to the bracket on the door. In either case, the free end of the door opening limiting bar is supported in stored position against the wall or door by a third bracket secured to the wall or door, as the case may be.

As a feature of the present invention, the door opening limiting bar may be selectively shortened or lengthened without disengaging the bar from the brackets on the door and the wall. This makes it possible to open the door a small distance sufficient to admit flat objects and through which the occupant of the room can converse with persons outside the door. The door opening limiting bar is effective to prevent further opening or closing of the door because the mechanical relationship of the parts is such that lengthening and shortening of the bar cannot be accomplished from outside the door. The described lengthening and shortening of the bar is accomplished simply by rotating the central portion of the bar around its axis, with rotation in one direction lengthening the overall reach of the bar and rotation in the opposite direction shortening its overall reach.

Easy and rapid engagement and disengagement of the door opening limiting bar of the present invention is provided by forming downwardly extending pins on members affixed to the ends of the bar, these pins being selectively engageable in upwardly opening sockets formed in the door and wall mounting brackets. The pins preferably have a taper fit in the sockets, and the bracket which remains engaged with the corresponding pin during storage is pivoted around an axis extending horizontally normal to the plane of door so that the bar may be freely swung between its operative and stored positions while still supporting at one end.

The door opening limiting bar of the present invention is made longitudinally expandable and contractable by forming it in telescoping sections axially movable relative to each other upon relative rotation about their common axis. The central part of the door opening limiting bar is in the form of an elongated tube having closed ends provided with axially threaded bores. Tubular end sections are telescopingly engaged over the closed ends of the elongated tube, and a wall closes off each of the outer ends of these end sections. A threaded rod is secured for joint rotation to each of such walls and extends axially inwardly and is threadably engaged in the threaded bores in the closed ends of the elongated tube. The rod at one end of the bar has a right hand thread while the rod at the other end of the bar has a left hand thread. Rotation of the elongated tube relative to the threaded rods in one direction thus causes the tubular end section to move relatively apart and rotation of the elongated tube relative to the threaded rods in the opposite direction causes the tubular end sections to move relatively toward each other.

The center section of the elongated tube can be lengthened or shortened to accomodate the apparatus to different sizes of doors, positions of studs in the walls to which the wall bracket should be mounted, etc. To accomplish this, the central section of the elongated tube is severed from the end sections of the tube and is releasably held thereto by axially spaced threaded collars. Removal of the central section and replacement by a corresponding section of different length provides the desired adjustment of the overall unit. With this structure, the end assemblies of the door opening limiting bar (consisting of the outer ends of the elongated tube, the tubular end section telescopingly engaged over same, the threaded rod carried on the tubular end section and threadably engaged with the end sections of the elongated tube, and the member and mounting pin attached thereto) can be substantially identical with each other, except for the "hand" of the threads so as to simplify production and reduce production costs.

Preferably, a corrugated sleeve of rubber-like material is mounted on the elongated tube so as to provide an effective area for manually grasping and twisting the elongated tube relative to the end sections. Also preferably, each of the downwardly extending pins at the ends of the door opening limiting bar is tapered toward its lower end, the socket for receiving the pin is complementarily tapered, and a limiting nut is threadably mounted on the pin to act as an adjustable stop for limiting penetration of the pin in the socket. This permits a tight fit of the parts to prevent the parts from shaking loose under an assault on the door, while still making it easy to remove the pins from the sockets.

Also preferably, either the first bracket or the second bracket is formed with a mounting plate, and an ear is pivotally mounted on and extending from the mounting plate for swinging movement about an axis normal to the mounting plate, with the pin receiving socket being formed in such ear. This facilitates movement of the door opening limiting bar of the present invention from its operative position to its stored position. To effect this change, one of the pins is lifted from its socket and the now free end of the bar is swung against the surface on which the other end is mounted, the bar being held in this, the stored position, by engaging the free end in a third bracket on such surface. The pivotal mounting of the ear containing the socket permits the other end of the bar to be supported at all times during the described swinging movement from operative position to stored position.

It is therefore a principal object of the present invention to provide a door opening limiting bar which holds the door securely in closed and slightly ajar positions against further opening of closing.

Another object of the present invention is to provide a door opening limiting bar of the character described which is operable for moving the door between its closed and ajar positions while at all times preventing unwanted further opening of the door by pressure against its outer side.

A further object of the present invention is to provide a door opening limiting bar of the character described in which expansion and contraction of the effective length of the bar is accomplished by manually grasping and twisting the central portion of the bar.

A still further object of the present invention is to provide a door opening limiting bar of the character described which is of sturdy unitary construction and which may be selectively and easily moved between its operative and stored positions.

Other objects and features of advantage will become apparent as the specification progresses and from the claims.

Figures 1, 2, 3, 4:
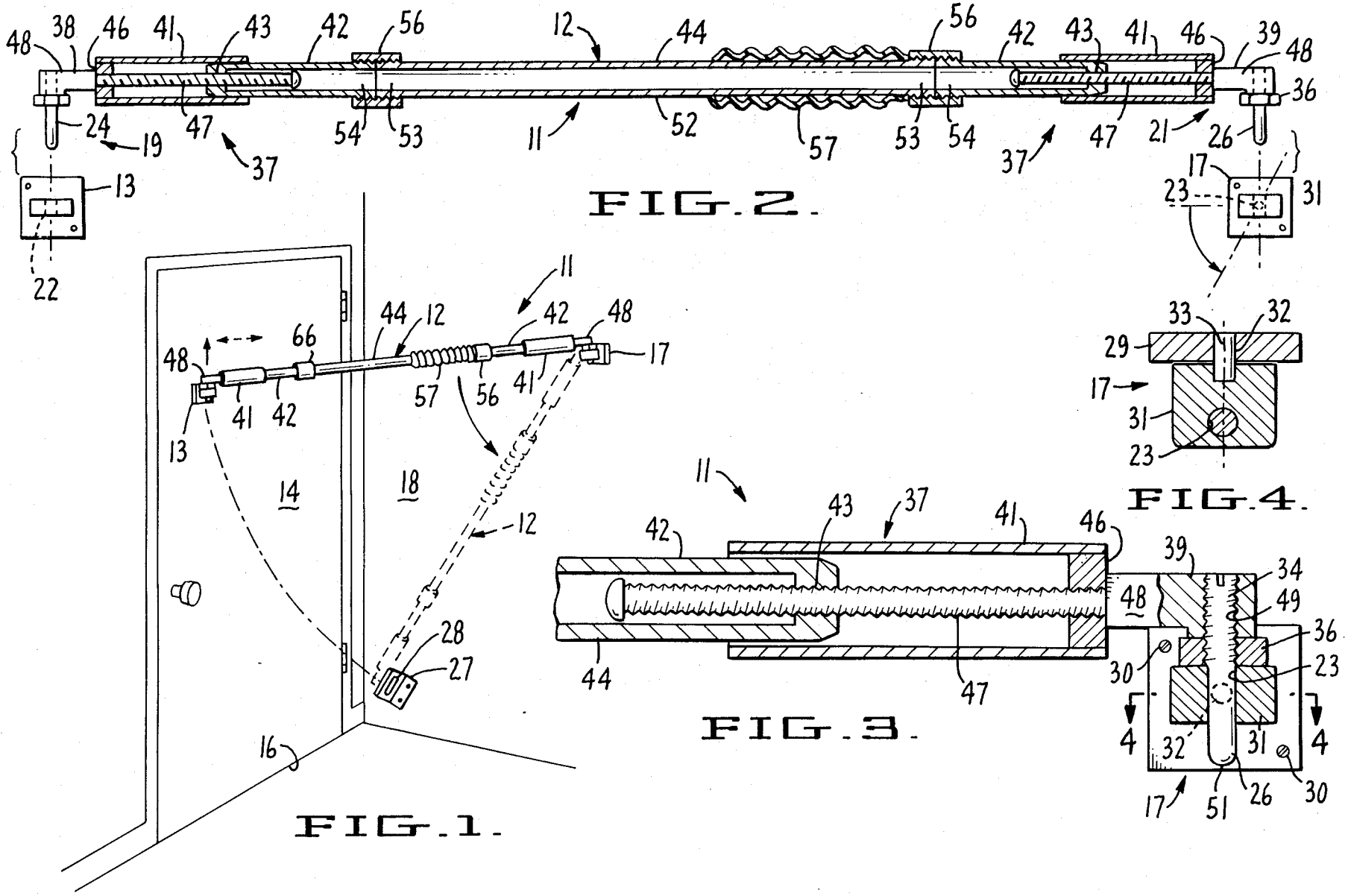
FIG. 1 is a perspective view of a door opening limiting bar installed in operative relationship to a conventional door.
FIG. 2 is a longitudinal vertical cross-sectional view through the door opening limiting bar of FIG. 1.
FIG. 3 is a vertical cross-sectional view of an enlarged scale taken through one end of the door opening limiting bar of FIG. 2 further illustrating the mode of mounting the bar.
FIG. 4 is a vertical cross-sectional view taken substantially on the plane of line 4—4 of FIG. 3.

While only the preferred form of the invention is illustrated in the drawing, it will be apparent that various modifications could be made without departing from the ambit of the claims.

DESCRIPTION OF THE PREFERRED EMBODIMENTS

As may be seen in the accompanying drawing, the door opening limiting bar 11 of the present invention provides an elongated rigid member 12, a first bracket 13 formed for attachment to the inner face of a hinged door 14 a spaced distance above the bottom of the door 16, a second bracket 17 formed for attachment to a wall 18 confronting said inner faces of said door 14 at approximately the same height as the bracket 13, and attachment means 19 and 21 on the opposite ends of the elongated rigid member 12 formed for selectively securing same to the bracket 13 and 17 whereby the elongated rigid member 12 prevents opening of the door 14 beyond a desired point.

The brackets 13 and 17 are formed with upwardly opening sockets 22 and 23 respectively. The attachment means 19 and 21 on the opposite ends of the elongated rigid member 12 are formed with downwardly projecting pins 24 and 26 removably engageable in the sockets 22 and 23, respectively. The brackets 13 and 17 may be mounted at any convenient height which will provide maximum strength.

A third bracket 27 is formed for attachment to the wall 18 in laterally and vertically spaced relation to the second bracket 17 and includes a slot 28 adapted to receive the pin 24. This makes it possible to lift pin 24 out of socket 22, swing the elongated rigid member downwardly to the position shown in dotted lines in FIG. 1 of the drawings, and there engage pin 24 in slot 28. Thus, the attachment means 19 can be disengaged from the first bracket 13 and selectively secured to the third bracket 27 for storing the elongated rigid member 12 against the wall when not in use for limiting opening of the door.

While normally it would be preferred to position the elongated rigid member 12 against the wall 18 when not in use, it should be realized that the elongated rigid member 12 could be supported on the inner face of the door 14 when not in use, should that be desired. In such case, the elongated rigid member 12 would swing around bracket 13 and bracket 27 would be mounted on the inner face of the door 14.

To facilitate the swinging action of member 12 between the operative position illustrated in solid lines in FIG. 1 of the drawings and its storage position, illustrated in dotted lines in FIG. 1 of the drawings, bracket 17 is formed to pivot with the movement of member 12. As may best be seen in FIGS. 3 and 4 of the drawings, bracket 17 has a mounting plate 29 securable to the wall 18, preferably by heavy screws 30 engaged with the studs in the wall. An ear 31 is pivotally mounted on mounting plate 29 as by means of pin 32 and extends horizontally from pin 32 for swinging movement about an axis 33 normal to the mounting plate 29, the socket 23 being formed in the ear 31.

As may best be seen in FIG. 3 of the drawings, the pins 24 and 26 are tapered toward their lower ends, and their mating sockets 22 and 23 are complementarily tapered. The upper ends of the pins 24 and 26 are threadably engaged in the end of the elongated rigid member 12 as shown at 34. A nut 36 is threadably engaged on the pins 24 and 26 to limit the depth of penetration of pin into its corresponding socket. The nut 36 acts as both a positioning and a lock nut to hold the pin in the desired position while, at the same time, limiting the penetration of the tapered pin into its complementarily tapered socket so the pin can be adjusted to have a tight fit in the socket while still permitting easy removal.

In accordance with the present invention, adjustment means 37 is provided for selectively increasing and shortening the distance between the opposite ends 38 and 39 of the elongated rigid member 12 so as to control the position of the door 14 between its closed position and a desired partially opened position.

For this purpose, the elongated rigid member 12 is longitudinally expansible and contractible by desired amounts for accomplishing the described selective increasing and shortening of the distance between the opposite ends 38 and 39 of the elongated rigid member 12.

The adjustment means 37 is operable for selectively increasing and decreasing the distance between the opposite ends of the elongated rigid member without disengaging the pins 24 and 26 on the ends 38 and 39 respectively from the sockets 22 and 23 formed in brackets 13 and 17 whereby the opening and closing of the door 14 is limited at all times while adjustment of the length of the elongated rigid member 12 is being accomplished.

As here shown, the elongated rigid member 12 is formed with telescoping sections 41 and 42 threadably joined together at 43 for relative axial movement upon relative rotation so as to provide the adjustment means 37.

As illustrated in the drawings, the elongated rigid member 12 includes an elongated tube 44 having closed ends 43 provided with axially threaded bores. Tubular end sections 41 are telescopingly engaged over the closed ends 43 of the elongated tube 44. Each of the outer ends 46 of the end sections 41 is provided with a wall having a threaded rod 47 secured thereto and extending axially inwardly of the tubular section 41. The rods 47 are threadably engaged in the threaded bores in the closed ends 43 of the elongated tube 44 so that rotation of the tube 44 relative to the threaded rods 47 in one direction causes the tubular end sections 41 to move relatively apart, and rotation of the elongated tube 44 relative to the threaded rods 47 in the opposite direction causes the tubular end sections 41 to move relatively toward each other.

As may best be seen in FIG. 3 of the drawings, the attachment means 19 and 21 each includes a shank section secured to each end wall 46 of the tubular end sections 41 and extending axially outwardly therefrom. The pins 24 and 26 are threadably engaged in a bore 49 formed laterally through the shank section 48, and each pin terminates in a rounded end 51 for facilitating entry of the pins 24 and 26 into their respective sockets 22 and 23.

Preferably, in order to make the unit adjustable to different installations, the elongated member 12 is made in three sections so that center sections of different lengths can be substituted to adapt the unit to different installations. As may best be seen in FIG. 2 of the drawings, a tubular center section 52 having externally threaded ends 53 is removably secured to corresponding threaded ends 54 on the tubular end sections 41. Internally threaded sleeves 56 releasably hold ends 53 and 54 together.

In order to facilitate twisting axial rotation of the section 44 of member 12 relative to the end section 41, a corrugated sleeve 57 is mounted on tube 44 so as to provide an effective area for manual grasping and twisting of the elongated tube 44 relative to the end sections 41.

From the foregoing, it should be apparent that the door opening limiting bar of the present invention provides a solid and secure way of preventing opening or closing of a door from a desired position, the unit being adapted for changing the position of the door without being disengaged.

I claim:

1. A door opening limiting bar, comprising an elongated rigid member, a first bracket formed for attachment to the inner face of a hinged door a spaced distance above the bottom thereof, a second bracket formed for attachment to a wall confronting said inner face of said door at approximately the same height as said first bracket, attachment means on the opposite ends of said elongated rigid member formed for selectively securing said ends to said first and second brackets whereby said elongated rigid member prevents opening of said door beyond a desired point, adjustment means on said elongated rigid member formed for selectively increasing and shortening the distance between said opposite ends of said elongated rigid member so as to control the position of said door between a closed position and a desired partially open position, said elongated rigid member being longitudinally expansible and contractable by desired amounts for accomplishing said selective increasing and shortening of the distance between said opposite ends of said elongated rigid member, said adjustment means being operable for selectively increasing and decreasing the distance between said opposite ends of said elongated rigid member without disengaging said ends from said first and second brackets whereby the opening of said door is limited at all times while adjustment of the length of said elongated rigid member is being accomplished, said elongated rigid member providing telescoping sections threadably joined together for relative axial movement upon relative rotation so as to provide said adjustment means, said elongated rigid member comprising an elongated tube having closed ends provided with axial threaded bores, tubular end sections telescopingly engaged over said closed ends of said elongated tube, a wall closing off each of the outer ends of said end sections, and a threaded rod secured to each of said walls and extending axially inwardly and being threadably engaged in said threaded bores in said closed end of said elongated tube corresponding to the end section in which said threaded rod is secured whereby rotation of said elongated tube relative to said threaded rods in one direction causes said tubular end sections to move relatively apart and rotation of said elongated tube relative to said threaded rods in the opposite direction causes said tubular end sections to move relatively together.

2. A door opening limiting bar as claimed in claim 1, and wherein said attachment means is secured to end walls on said tubular end sections and comprises a shank section secured to each end wall of each tubular end sections extends outwardly therefrom, a pin is threadably engaged in a bore formed laterally through said shank section and terminates in a rounded end, said first and second brackets being formed with upwardly opening sockets, and said rounded ends of said pins being removably engageable in said sockets.

3. A door opening limiting bar as claimed in claim 1, and wherein said elongated tube comprises a tubular center section having externally threaded ends, a pair of tubular end sections of similar diameter to said center section with each end section having a closed outer end formed to provide said axial threaded bore and an open inner externally threaded end, internally threaded sleeves formed for receiving said externally threaded ends of said tubular center section and said tubular end sections and holding same together.

4. A door opening limiting bar as claimed in claim 1, and wherein a corrugated sleeve of rubber-like material is mounted on said elongated tube so as to provide an effective area for manual grasping and twisting of said elongated tube relative to said end sections.

5. A door opening limiting bar as claimed in claim 2, and wherein said pin is tapered toward its lower end, said socket is complementarily tapered, and a limiting nut is threadably mounted on said pin to act as an adjustable stop for limiting penetration of said pin in said socket.

6. A door opening limiting bar, comprising an elongated rigid member, a first bracket formed for attachment to the inner face of a hinged door a spaced distance above the bottom thereof, a second bracket formed for attachment to a wall confronting said inner face of said door at approximately the same height as said first bracket, and attachment means on the opposite ends of said elongated rigid member formed for selectively securing same to said first and second brackets whereby said elongated rigid member prevents opening of said door beyond a desired point, and wherein one of said first bracket and said second bracket is formed with a mounting plate, and an ear pivotally mounted on and extending from said mounting plate for swinging movement about an axis normal to said mounting plate, said socket being formed in said ear.

7. For use with a hinged door swingably mounted in a frame positioned in a first wall adjacent to a perpendicularly intersecting second wall toward and away from which such door can be swung, a door opening limiting bar assembling comprising an elongated rigid member having first and second opposite ends, a first bracket formed for attachment to the face of said door confronting said perpendicularly intersecting second wall a spaced distance above the bottom of said door, a second bracket formed for attachment to said perpendicularly intersecting second wall at approximately the same height as said first bracket, attachment means of said first and second ends of said rigid member formed for selectively securing said first and second ends to said first and second brackets respectively whereby said elongated rigid member extends diagonally between said door and said perpendicularly intersecting second wall and prevents movement of said brackets relative to each other so as to thus prevent said door from moving relative to said perpendicularly intersecting second wall, said brackets being formed with upwardly opening sockets, said attachment means on said opposite ends of said elongated rigid member being forme with downwardly projecting pins removably engagable in said sockets, adjustment means on said elongated rigid member for selectively increasing and shortening the distance between said opposite ends of said elongated rigid member so as to adjust the position of said door between a closed position and a desired partially open position, said elongated rigid member being longitudinally expansible and contractable by desired amounts for accomplishing said selective increasing and shortening of the distance between said opposite ends of said elongated rigid member, said adjustment means being operable for selectively increasing and decreasing the distance between said opposite ends of said elongated rigid member without disengagement of said ends from said first and second brackets whereby said movement of said door is limited at all times while adjustment of the length of said elongated rigid member is being accomplished, said elongated rigid member having telescoping sections threadably joined together for relative axial movement upon relative rotation so as to provide said adjustment means, said elongated rigid member comprising an elongated tube having closed ends provided with axial threaded bores, tubular end sections telescopingly engaged over said closed ends of said elongated tube, a wall closing off each of the outer ends of said end sections, and a threaded rod secured to each of said walls and extending axially inwardly for threadable engagement in said threaded bores in said closed end of said elongated tube corresponding to the end section in which such threaded rod is secured whereby rotation of said elongated tube relative to said threaded rods in one direction causes said tubular end sections to move relative apart and rotation of said elongated tube relative to said threaded rods in the opposite direction causes said tubular end sections to move relatively together.

8. A door opening limiting bar as claimed in claim 7, and wherein said attachment means is secured to end walls on said tubular end sections and comprises a shank section secured to each end wall to each tubular end sections and extending outwardly therefrom, a pin threadably engaged in a bore formed laterally through said shank section and terminating in a rounded end, said first and second brackets being formed with upwardly opening sockets, and said rounded ends of said pins being removably engageable in said sockets.

9. A door opening limiting bar as claimed in claim 7, and wherein said elongated tube comprises a tubular center section having externally threaded ends, a pair of tubular end sections with each end section having a closed outer end and an open inner end formed to receive an end of said tubular center section, an externally threaded rod extending axially from each of said closed outer ends inwardly past said open ends, said ends of said center section being formed with internally threaded bores threadably engaged with said rod.

10. A door opening limiting bar as claimed in claim 7, and wherein a corrugated sleeve of rubber-like material is mounted on said elongated tube so as to provide an effective area for manual grasping and twisting of said elongated tube relative to said end sections.

11. A door opening limiting bar as claimed in claim 8, and wherein said pin is tapered toward is lower end, said socket is complementarily tapered, and a limiting nut is threadably mounted on said pin to act as an adjustable stop for limiting penetration of said pin in said socket.

12. For use with a hinged door swingably mounted in a frame positioned in a first wall adjacent to a perpendicularly intersecting second wall toward and away from which such door can be swung, a door opening limited bar assembly comprising an elongated rigid member having first and second opposite ends, a first bracket formed for attachment to the face of said door confronting said perpendicularly intersecting second wall a spaced distance above the bottom of said door, a second bracket formed for attachment to said perpendicularly intersecting second wall at approximately the same height as said first bracket, attachment means on said first and second ends of said rigid member formed for selectively securing said first and second ends to said first and second brackets respectively whereby said elongated rigid member extends diagonally between said door and said perpendicularly intersecting second wall and prevents movement of said brackets relative to each other so as to thus prevent said door from moving relative to said perpendicularly intersecting second wall, one of said first and second brackets being formed with a mounting plate, and an ear pivotally mounted on an extending from said mounting plate for swinging movement about an axis normal to said mounting plate, said socket being formed in said ear.

13. A door opening limiting bar, comprising an elongated rigid member, a first bracket formed for attachment to the inner face of a hinged door a spaced distance above the bottom thereof, a second bracket formed for attachment to a wall confronting said inner face of said door at approximately the same height as said first bracket at a distance corresponding to the length of said elongated rigid member, attachment means on the opposite ends of said elongated rigid member formed for selectively securing said ends to said first and second bracket whereby said elongated rigid member prevents opening of said door beyond a desired point, adjustment means on said elongated rigid member formed for selectively increasing and shortening the distance between said opposite ends of said elongated rigid member so as to control the position of said door between a closed position and a desired partially open position, said elongated rigid member being longitudinally expansible and contractable by desired amounts for accomplishing said selective increasing and shortening of the distance between said opposite ends of said rigid member and hence correspondingly increasing and shortening the distance between said brackets by swinging said door on its hinges, said adjustment means being operable for selectively increasing and decreasing the distance between said opposite ends of said elongated rigid member without disengaging said ends from said first and second brackets whereby the opening of said door is limited at all times while adjustment of the length of said elongated rigid member is being accomplished, said elongated rigid member comprising telescoping sections threadable joined together for relative axial movement upon relative rotation so as to provide said adjustment means.

* * * * *